US012612676B2

(12) United States Patent
Denks et al.

(10) Patent No.: US 12,612,676 B2
(45) Date of Patent: Apr. 28, 2026

(54) METHOD FOR PRODUCING A STEEL STRIP WITH A MULTIPHASE STRUCTURE, AND RELATED STEEL STRIP

(71) Applicant: Salzgitter Flachstahl GmbH, Salzgitter (DE)

(72) Inventors: Ingwer Denks, Wolfenbüttel (DE); Jan Roik, Wolfenbüttel (DE); Konstantin Molodov, Braunschweig (DE)

(73) Assignee: Salzgitter Flachstahl GmbH, Salzgitter (DE)

( * ) Notice: Subject to any disclaimer, the term of this patent is extended or adjusted under 35 U.S.C. 154(b) by 591 days.

(21) Appl. No.: 17/918,988

(22) PCT Filed: Apr. 14, 2021

(86) PCT No.: PCT/EP2021/059672

§ 371 (c)(1),
(2) Date: Oct. 14, 2022

(87) PCT Pub. No.: WO2021/209503

PCT Pub. Date: Oct. 21, 2021

(65) Prior Publication Data

US 2023/0077921 A1 Mar. 16, 2023

(30) Foreign Application Priority Data

Apr. 15, 2020 (DE) ..... 102020110319.0

(51) Int. Cl.

| | |
|---|---|
| ***C22C 38/02*** | (2006.01) |
| ***C21D 1/19*** | (2006.01) |
| ***C21D 1/25*** | (2006.01) |
| ***C21D 1/26*** | (2006.01) |
| ***C21D 1/28*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 9/48*** | (2006.01) |
| ***C21D 9/52*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/38*** | (2006.01) |

(52) U.S. Cl.

CPC ..... *C21D 9/52* (2013.01); *C21D 1/19* (2013.01); *C21D 1/25* (2013.01); *C21D 1/26* (2013.01); *C21D 1/28* (2013.01); *C21D 6/005* (2013.01); *C21D 8/0205* (2013.01); *C21D 8/0226* (2013.01); *C21D 8/0236* (2013.01); *C21D 8/0273* (2013.01); *C21D 9/48* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/38* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C22C 38/04

See application file for complete search history.

(56) References Cited

U.S. PATENT DOCUMENTS

| | | | |
|---|---|---|---|
| 2008/0175743 | A1 | 7/2008 | Futatsuka et al. |
| 2016/0017472 | A1 | 1/2016 | Ennis |
| 2019/0003002 | A1 | 1/2019 | Seo |

FOREIGN PATENT DOCUMENTS

| | | | |
|---|---|---|---|
| DE | 102012002079 | A1 | 8/2013 |
| DE | 102012006017 | A1 | 9/2013 |
| DE | 102014017273 | A1 | 5/2016 |
| DE | 102014017274 | A1 | 5/2016 |
| DE | 102015111177 | A1 | 1/2017 |
| DE | 102017123236 | A1 | 4/2019 |

(Continued)

OTHER PUBLICATIONS

English machine translation of JP 2013-144830 A of Nomura (Year: 2013).*

(Continued)

*Primary Examiner* — Jophy S. Koshy

(74) *Attorney, Agent, or Firm* — Gardner, Linn, Burkhart & Ondersma LLP

(57) ABSTRACT

A method for producing a steel strip with a multiphase structure by which the production of complex geometries with a high energy-absorption capacity and high resistance to edge cracking is provided achieving a high yield strength or high yield-strength ratio and a high elongation at break, comprising producing a rolled steel strip of particular elements, and first annealing the steel strip at a temperature of between 750° C. and 950° C., and subsequently first cooling of the steel strip to a temperature of between 200° C. and 500° C. at an average cooling rate of 2 K/s to 150 K/s, further cooling of the steel strip to a supercooling temperature below 100° C. at an average cooling rate of 1 K/s to 50 K/s, final annealing of the steel strip with a Hollomon-Jaffe parameter, and final cooling of the steel strip to room temperature at an average cooling rate of 1 K/s to 160 K/s.

6 Claims, 2 Drawing Sheets

(56) References Cited

FOREIGN PATENT DOCUMENTS

| | | | | |
|---|---|---|---|---|
| EP | 1867747 | A1 | | 12/2007 |
| EP | 3027784 | B1 | | 8/2017 |
| EP | 3476963 | A1 | | 5/2019 |
| JP | 2013144830 | A | * | 7/2013 |
| JP | 5741456 | B2 | | 7/2015 |
| WO | 2017001303 | A1 | | 1/2017 |
| WO | 2020058330 | A1 | | 3/2020 |

OTHER PUBLICATIONS

Preliminary Report on Patentability of the International Searching Authority in English from corresponding Patent Cooperation Treaty (PCT) Application No. PCT/EP2021/059672, completed Jul. 13, 2022.

International Search Report of the International Searching Authority and English Translation from corresponding Patent Cooperation Treaty (PCT) Application No. PCT/EP2021/059672, indicated completed on Jun. 4, 2021.

* cited by examiner

METHOD FOR PRODUCING A STEEL STRIP WITH A MULTIPHASE STRUCTURE, AND RELATED STEEL STRIP

CROSS REFERENCE TO RELATED APPLICATION

The present application claims the priority benefits of International Patent Application No. PCT/EP2021/059672, filed Apr. 14, 2021, and claims the benefit of German patent application DE 10 2020 110 319.0, filed Apr. 15, 2020.

BACKGROUND AND FIELD OF THE INVENTION

The invention relates to a method of producing a steel strip having a multiphase microstructure and to a steel strip having a multiphase microstructure.

"Steel strip" is understood hereinafter to be a hot-rolled or cold-rolled and annealed steel strip. Typical thicknesses of a hot-rolled steel strip, also referred to as hot strip, are between 2 mm and 8 mm. Cold-rolled, annealed steel strips are referred to as cold strip or fine sheet and typically have thicknesses in the range of 0.5 mm to 2.5 mm.

The fiercely competitive car market means that producers are constantly forced to find solutions for reducing fleet fuel consumption and $CO_2$ exhaust emissions whilst maintaining the highest possible level of comfort and passenger protection. On the one hand, the weight saving of all of the vehicle components plays a decisive role as does, on the other hand, the most favourable possible behaviour of the individual components in the event of high static and dynamic loading during operation and also in the event of a crash.

The steel suppliers take the aforementioned problem into account by providing ultra high strength steels. Furthermore, by providing ultra high strength steels having a smaller sheet thickness, the weight of the vehicle components can be reduced whilst the behaviour of components remains the same or is possibly even improved.

These newly developed steels must satisfy not only the required weight reduction but also the high material requirements in relation to elasticity limit, tensile strength and elongation at fracture and bake hardening and also the high component requirements according to toughness, edge crack insensitivity, improved bending angle and bending radius, energy absorption and a defined hardening relating to the work hardening effect.

Furthermore, it is necessary to ensure good processability. This relates both to the processes performed by the car producer, e.g. stamping and forming, optional thermal quenching with subsequent optional tempering, welding and/or surface post-treatment, such as phosphatising and cathodic dip coating, and also the manufacturing processes performed by the suppliers of semi-finished products, such as e.g. surface finishing by means of metallic or organic coating.

Improved joining suitability, e.g. in the form of better general welding capability, as well as a larger usable welding area for resistance spot welding and improved failure behaviour of the weld seam (fracture pattern) under mechanical stress, and a high resistance to liquid metal embrittlement (LME) are also required to an increasing extent. Moreover, sufficient resistance to delayed hydrogen embrittlement (i.e. delayed fracture free) is sought. The same applies to the welding suitability of ultra high strength steels in the production of pipes which are produced e.g. by means of the high-frequency induction welding method (HFI).

The automotive industry is increasingly demanding grades of steel which have requirements in terms of the ratio of yield strength $R_e$ or elasticity limit $R_{p0.2}$ to tensile strength $R_m$ which differ considerably depending upon the application.

The combination of properties required of the steel material ultimately represents a component-specific compromise of individual properties. However, these properties are often no longer adequate in the case of ever more complex component geometries.

A low yield strength ratio ($R_e/R_m$) of e.g. less than 0.6 combined with very high tensile strength, strong cold solidification and good cold-formability is typical of a dual-phase steel and is primarily used for formability in stretching and deep-drawing procedures.

Dual-phase steels consist of a ferritic basic microstructure, into which a martensitic second phase is incorporated. It has been found that in the case of low-carbon, microalloyed steels, small proportions of further phases, such as bainite and residual austenite, have an advantageous effect e.g. upon the hole expansion behaviour, the bending behaviour and the hydrogen-induced brittle fracture behaviour. In this case, bainite can be present in different manifestations, such as e.g. upper and lower bainite.

A higher yield strength ratio $R_e/R_m$, as is typical of complex-phase steels or multiphase steels, is also characterised inter alia by a high resistance to edge cracks. This can be attributed to the smaller differences in the strengths of the individual microstructure components, which has a favourable effect upon homogeneous deformation in the region of the cut edge. These steels also have a high energy absorption capacity in crash situations, for which reason these complex steels or multiphase steels are increasingly used in automotive engineering. The multiphase microstructure is characterised by a predominantly ferritic-bainitic basic matrix, wherein proportions of martensite, tempered martensite, residual austenite and/or pearlite can also be present. Delayed recrystallisation or precipitation of microalloy elements produces a strong grain refinement (i.e. fine-grained microstructure) and thus a high strength.

These complex-phase steels or multiphase steels have higher yield strengths, a greater yield strength ratio or elasticity limit ratio, lower cold solidification and a higher hole expansion capability compared with dual-phase steels. Therefore, such steels are excellently suited for the production of components with complex geometry, in particular in the case of crash-stressed components which require a high energy absorption capacity.

Multiphase steels are known e.g. from laid-open documents DE 10 2012 002 079 A1 and from DE 10 2015 111 177 A1. With the material properties disclosed therein, relatively complex component geometries can already be produced, but there is a requirement for even higher elasticity limit ratios, with which even more complex component geometries can be realised with high edge crack resistance and high energy absorption capacity.

If thin sheets are to be produced, economic reasons dictate that the cold-rolled steel strips are typically annealed in the continuous annealing method in a recrystallising manner to produce a thin sheet which can be formed in an effective manner. In dependence upon the alloy composition and the strip cross-section, the process parameters, such as throughput speed, annealing temperatures and cooling rate, must be set corresponding to the required mechanical-technological properties with the microstructure required for this purpose.

In order to achieve a fine-grain microstructure after the continuous annealing procedure, it is known that a minimum degree of cold-rolling is set in dependence upon the recrystallisation temperature, in order to set a corresponding dislocation density for the recrystallisation annealing.

If the degree of thinning by cold-rolling is too low—even in local regions —, the critical threshold for recrystallisation cannot be overcome and so a fine-grain and relatively uniform microstructure cannot be achieved. After recrystallisation, different grain sizes in the cold strip also give rise to different grain sizes in the final microstructure, which results in fluctuations in the characteristic values. During cooling from the furnace temperature, grains of different sizes can convert into different phase components and ensure further inhomogeneity.

In order to achieve the respectively required microstructure, the cold strip is heated in the continuous annealing furnace to a temperature at which, during cooling, the required microstructure formation (e.g. dual-phase or complex-phase microstructure) is achieved.

If, by reason of high corrosion protection requirements, the surface of the cold strip is to be hot-dip galvanised, the annealing treatment is typically performed in a continuous hot-galvanising installation, in which the heat treatment or annealing and the downstream galvanising take place in a continuous process.

Even in the case of hot-rolled strip, depending on the alloy concept, the required microstructure is only set during annealing treatment in the continuous furnace in order to achieve the required mechanical properties.

It has transpired to be disadvantageous in the case of these multiphase steels or complex-phase steels that although a high elasticity limit ratio can be achieved after austenitising annealing of the hot or cold strip in the continuous furnace, this is achieved at the cost of a lower elongation at fracture $A_{80}$ compared to dual-phase steels. If a high elongation at fracture $A_{80}$ is required, a high elasticity limit ratio can no longer be set in a process-reliable manner. The cause of this is that during the large-scale continuous annealing procedure, depending on the alloy concept, the reconversion of the austenite into bainite does not take place completely, since the residual austenite in the holding region is enriched with carbon at temperatures of 200° C. to 500° C. and is thus stabilised. By reason of the final cooling to a temperature less than 100° C., the remaining austenite then converts into martensite (fresh martensite). By reason of the formation of fresh martensite and the associated shear deformation, slidable dislocations are produced in the surrounding microstructure, which from a technological point of view manifests itself in a lowering of the $R_{p0.2}$ elasticity limit and in increased edge crack sensitivity.

SUMMARY OF THE INVENTION

The present invention provides a method for producing a steel strip having a multiphase microstructure and a steel strip having a multiphase microstructure, with which the production of complex component geometries with high energy absorption capacity and high edge crack resistance is made possible. In particular, the method is intended to compensate for the drop in elasticity limit and thus achieve a combination of high elasticity limit or high elasticity limit ratio and high elongation at fracture. A corresponding cold-rolled or hot-rolled steel strip is also to be provided.

According to embodiments of the invention, a high-strength and high-ductility steel strip consisting of a multiphase steel is achieved in accordance with the invention by means of the method for producing a steel strip having a multiphase microstructure comprising the steps of: Producing a hot-rolled or cold-rolled steel strip from a steel consisting of the following elements in wt. %: C: 0.085 to 0.149; Al: 0.005 to 0.1; Si: 0.2 to 0.75; Mn: 1.6 to 2.9; P: ≤0.02; S: ≤0.005; and optionally one or more of the following elements in wt. %: Cr: 0.05 to 0.5; Mo: 0.05 to 0.5; Ti: 0.005 to 0.060; Nb: 0.005 to 0.060; V: 0.001 to 0.060; B: 0.0001 to 0.0060; N: 0.0001 to 0.016; Ni: 0.01 to 0.5; Cu: 0.01 to 0.3, with the remainder being iron including typical steel-associated elements; First annealing, in particular continuous annealing, of the steel strip, in particular of the cold-rolled steel strip, at a temperature between 750° C. to 950° C. inclusive for the total duration of 10 s to 1200 s, in particular of 50 s to 650 s, and subsequently first cooling of the steel strip to a temperature between 200° C. to 500° C. inclusive with an average cooling rate of 2 K/s to 150 K/s, in particular of 5 K/s to 100 K/s; Further cooling of the steel strip to a supercooling temperature below 100° C. with an average cooling rate of 1 K/s to 50 K/s; Final annealing, in particular continuous annealing, of the steel strip with a Hollomon-Jaffe parameter $Hp=T_H*(\ln(\tau)+20)$ of $>7.5\times10^3$, wherein the maximum temperature $T_H$ in K is 100° C. to 470° C. inclusive and the total duration T in h is 2 s to 1000 s inclusive; And final cooling of the steel strip to room temperature at an average cooling rate of 1 K/s to 160 K/s, in particular 1 K/s to 30 K/s.

In an advantageous manner, the elasticity limit can be variably set via the final-annealing and final-cooling depending upon the process parameters and a high ratio of the $R_{p0.2}$ elasticity limit of the finally annealed steel strip to the tensile strength $R_m$ of the finally annealed steel strip can be achieved.

Furthermore, the steel strip in accordance with the invention has good weldability and has a low tendency to liquid metal embrittlement and hydrogen embrittlement. These and further advantages of the steel strip in accordance with the invention are achieved by the alloy concept and also the particular processing. The steel strip is particularly suitable for producing components which then have improved formability, increased energy absorption capacity and improved welding properties.

During the course of the method in accordance with the invention for producing a steel strip, the two method steps "final annealing and final cooling" can follow one another directly in terms of time and also in terms of location or, depending upon the circumstances, can take place staggered by hours or days or at a different location.

DETAILED DESCRIPTION OF THE PREFERRED EMBODIMENTS

Figure 1:
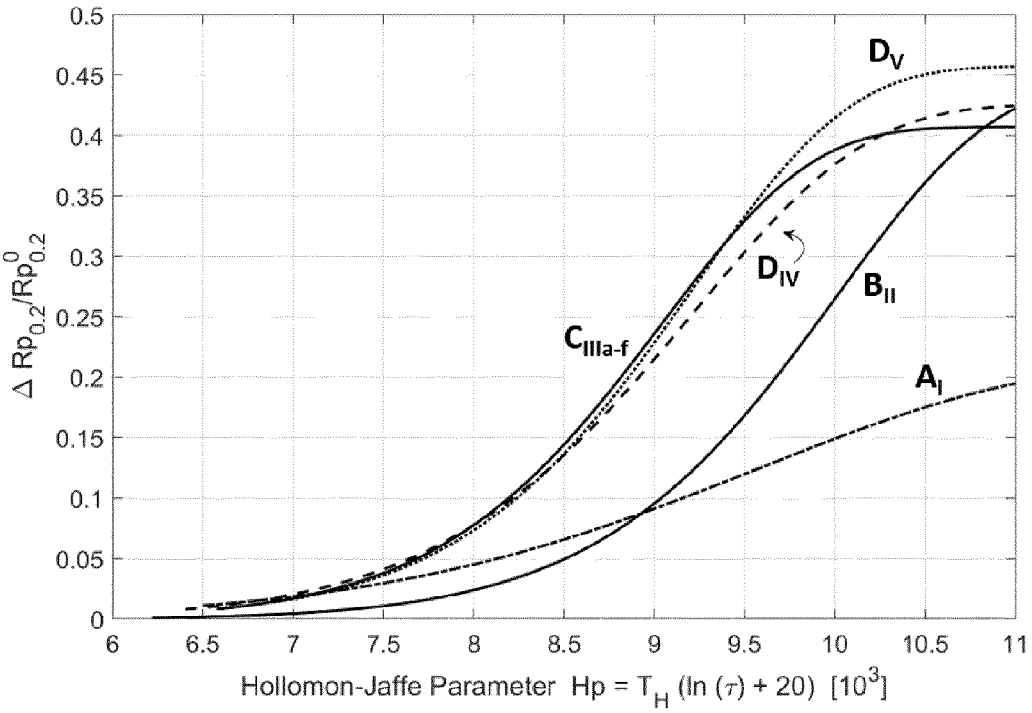
FIG. 1 illustrates a diagram of a relative increase in the $R_{p0.2}$ elasticity limit of a steel sheet, as achieved by the final annealing in accordance with the invention, as a function of the Hollomon-Jaffe parameter Hp.

Table 1 below shows a comparison of the respective alloy composition of reference steels $A_I$ and $B_{II}$ with example steels $C_{III}$, $D_{IV}$, $D_V$, $E_{VI}$, $F_{VII}$ to $G_{VIII}$ in accordance with the invention. The example steels $D_{IV}$, $D_V$ are identical in terms of their alloy composition and are only given a different index for a later description. A significant difference between the example steels in accordance with the invention and the reference steels is a lower carbon content, which improves weldability and minimises susceptibility to liquid metal embrittlement and hydrogen embrittlement. The reference steels $A_I$ and $B_{II}$ are not inventive because the C content is too high. This results in poorer weldability. Moreover, the tensile strength is too low (less than 920 MPa). Also, the reference steels $A_I$ and $B_{II}$ do not react as effectively to the treatment in accordance with the invention.

The effect of the elements in the inventive steel strip having a multiphase microstructure will be described in greater detail hereinafter. The multiphase steels are typically chemically structured in such a way that alloy elements with and also without microalloy elements are combined. Associated elements are unavoidable and, if necessary, are taken into consideration in the analysis concept in terms of their effect.

Associated elements are elements which are already present in the iron ore or get into the steel as a result of the production process. They are generally undesired by reason of their predominantly negative influences. The attempt is made to remove them to a tolerable content level or to convert them into less damaging forms.

Hydrogen (H) can diffuse as a single element through the iron lattice, without producing lattice tensions. As a result, the hydrogen in the iron lattice is relatively mobile and can be relatively easily absorbed during the manufacturing process. Hydrogen can be absorbed into the iron lattice only in atomic (ionic) form. Hydrogen exerts a significant embrittling effect and diffuses preferably to locations which are favourable in terms of energy (flaws, grain boundaries etc.). Flaws thus function as hydrogen traps and can considerably increase the dwell time of the hydrogen in the material. Cold cracks can be produced by means of a recombination to molecular hydrogen. This behaviour occurs in the event of hydrogen embrittlement or in the event of hydrogen-induced tension crack corrosion. Even in the case of delayed cracking, so-called delayed fracture, which occurs without external tensions, hydrogen is often stated to be the reason. Therefore, the hydrogen content in the steel should be kept as small as possible.

Oxygen (O): in the molten state, the steel has a relatively large absorbency for gases, however at room temperature oxygen is soluble only in very small quantities. In a similar manner to hydrogen, oxygen can diffuse only in atomic form into the material. Owing to the highly embrittling effect and the negative effects upon the ageing resistance, every attempt is made during production to reduce the oxygen content. On the one hand, procedural approaches such as vacuum treatment and, on the other hand, analytical approaches are provided in order to reduce the oxygen. By adding specific alloy elements, the oxygen can be converted into less dangerous states. For instance, it is generally conventional to bind the oxygen via manganese, silicon and/or aluminium. However, the resulting oxides can produce negative properties as flaws in the material. In contrast, in the case of fine precipitation, specifically of aluminium oxides, grain refinement can also take place. Therefore, for the reasons stated above the oxygen content in the steel should be kept as small as possible.

Nitrogen (N) is likewise an associated element from the production of steel. Steels with free nitrogen tend to have a strong ageing effect. The nitrogen diffuses even at low temperatures to dislocations and blocks same. It thus produces an increase in strength associated with a rapid loss of toughness. Binding of the nitrogen in the form of nitrides is possible e.g. by addition by alloying of aluminium or titanium. For the reasons stated above, the optional nitrogen content is limited to ≤0.016 wt. % or to quantities which are unavoidable in the production of steel.

Sulphur (S), like phosphorous, is bound as a trace element in the iron ore. It is not desirable in steel (the exception being machining steels) because it exhibits a strong tendency towards segregation and has a greatly embrittling effect. An attempt is therefore made to achieve amounts of sulphur in the melt which are as low as possible (e.g. by deep vacuum treatment). Furthermore, the sulphur present is converted by the addition of manganese into the relatively innocuous compound manganese sulphide (MnS). The manganese sulphides are often rolled out in lines during the rolling process and function as nucleation sites for the conversion. Primarily in the case of a diffusion-controlled conversion this produces a microstructure of pronounced lines and, in the case of a highly pronounced line formation, can result in impaired mechanical properties (e.g. pronounced martensite lines instead of distributed martensite islands, anisotropic material behaviour, reduced elongation at fracture). For the reasons stated above, the sulphur content is limited to ≤0.005 wt. % or to quantities which are unavoidable in the production of steel.

Phosphorous (P) is a trace element from the iron ore and is dissolved in the iron lattice as a substitution atom. Phosphorus increases hardness by means of mixed crystal hardening and improves hardenability. However, attempts are generally made to lower the phosphorus content as much as possible because inter alia it exhibits a strong tendency towards segregation owing to its low diffusion rate and greatly reduces the level of toughness. The attachment of phosphorous to the grain boundaries causes grain boundary fractures. Moreover, phosphorous increases the transition temperature from tough to brittle behaviour up to 300° C. During hot-rolling, near-surface phosphorous oxides at the grain boundaries can result in the formation of fractures. The addition by alloying of small quantities of boron can partially compensate for the negative effects of phosphorus. It is believed that boron increases grain boundary cohesion and reduces phosphorus segregation at grain boundaries.

However, in some steels owing to the low costs and high increase in strength, it is used in small quantities (<0.1%) as a microalloy element, e.g. in higher-strength IF steels (interstitial free). For the reasons stated above, the phosphorous content is limited to s 0.020% or to quantities which are unavoidable in the production of steel.

Alloy elements are generally added to the steel in order to influence specific properties in a targeted manner. An alloy element can thereby influence different properties in different steels. The correlations are varied and complex. The effect of the alloy elements will be discussed in greater detail hereinafter.

Carbon (C) is considered to be the most important alloy element in steel. Its targeted introduction at an amount up to 2.06% turns iron first into steel. The carbon proportion is often drastically reduced during the production of steel. In the case of the multiphase steel in accordance with the invention, in particular for continuous hot-dip finishing, its content is 0.085 wt. % to 0.149 wt. %, preferably to 0.115 wt. %. Carbon is interstitially dissolved in the iron lattice owing to its comparatively small atomic radius. The solubility is at most 0.02% in the α-iron and is at most 2.06% in the γ-iron. In dissolved form, carbon considerably increases the hardenability of steel. The different solubility makes pronounced diffusion procedures necessary during the phase conversion, which procedures can result in very different kinetic conditions. Moreover, carbon increases the thermodynamic stability of the austenite, which is demonstrated in the phase diagram in an extension of the austenite region at lower temperatures. As the forcibly dissolved carbon content in the martensite increases, the lattice distortions and, associated therewith, the strength of the phase produced without diffusion increase. In addition, carbon is necessary to form carbides. One representative which occurs almost in every steel is cementite (Fe3C). However, substantially harder special carbides can be formed with other metals such as e.g. chromium, titanium, niobium, vanadium. Therefore, it is not only the type but also the distribution and extent of the precipitations which is of crucial significance for the resulting increase in strength. Therefore, in order to ensure, on the one hand, sufficient strength and, on the other hand, good weldability, the minimum C content is fixed to 0.085 wt. % and the maximum C content is fixed to 0.149 wt. %, preferably to 0.115 wt. %.

Aluminium (Al) is generally added to the steel by alloying in order to bind the oxygen and nitrogen dissolved in the iron. The oxygen and nitrogen are thus converted into aluminium oxides and aluminium nitrides. These precipitations can effect grain refinement by increasing the nucleation sites and can thus increase the toughness properties and strength values. Aluminium nitride is not precipitated if titanium is present in sufficient quantities. Titanium nitrides have a lower enthalpy of formation and are formed at higher temperatures. In the dissolved state, aluminium, like silicon, shifts the formation of ferrite towards shorter times and thus permits the formation of sufficient ferrite. It also suppresses the formation of carbide and thus results in a delayed conversion of the austenite. For this reason, Al is also used as an alloy element in residual austenite steels in order to substitute a part of the silicon with aluminium. The reason for this approach resides in Al being slightly less critical for the galvanisation reaction than Si. Therefore, the Al content is limited to 0.005 wt. % to at most 0.1 wt. %.

During casting, silicon (Si) binds oxygen and therefore reduces segregations and impurities in the steel. Moreover, by means of mixed crystal hardening silicon increases the strength and yield strength ratio of the ferrite with the elongation at fracture only decreasing slightly. A further important effect is that silicon shifts the formation of ferrite towards shorter times and therefore permits the production of sufficient ferrite prior to quench hardening. The formation of ferrite causes the austenite to be enriched with carbon and stabilised. In the case of higher contents, silicon markedly stabilises the austenite in the low temperature range specifically in the region of bainite formation by preventing the formation of carbide. During hot rolling, highly adhesive scales which can impair further processing can form at high silicon contents. In the case of continuous galvanising, silicon can diffuse to the surface during annealing and can form film-like oxides alone or together with manganese. These oxides worsen the galvanising capability by impairing the galvanising reaction (iron dissolution and inhibition layer formation) when the steel strip is dipped into the zinc melt. This is manifested in poor zinc adhesion and non-galvanised regions. However, by means of a suitable furnace operation with adapted moisture content in the annealing gas and/or by means of a low Si/Mn ratio and/or by using moderate amounts of silicon, it is possible to ensure good galvanising capability of the steel strip and good zinc adhesion. For the reasons stated above, the minimum Si content is fixed to 0.200 wt. % and the maximum Si content is fixed to 0.750 wt. %.

Manganese (Mn) is added to almost all steels for the purpose of desulphurisation in order to convert the noxious sulphur into manganese sulphides. Moreover, by means of mixed crystal hardening manganese increases the strength of the ferrite and shifts the conversion towards lower temperatures. A main reason for adding manganese by alloying is the considerable improvement in the potential hardness increase. By reason of the inhibition of diffusion, the perlite and bainite conversion is shifted towards longer times and the martensite starting temperature is decreased. Manganese, like silicon, tends to form oxides on the steel surface during the annealing treatment. In dependence upon the annealing parameters and the contents of other alloy elements (in particular Si and Al) manganese oxides (e.g. MnO) and/or Mn mixed oxides (e.g. $Mn_2SiO_4$) can occur. However, manganese is to be considered to be less critical in a small Si/Mn or Al/Mn ratio because globular oxides are more likely to form instead of oxide films. Nevertheless, high manganese contents can negatively influence the appearance of the zinc layer and the zinc adhesion. Therefore, the Mn content is limited to 1.6 wt. % to 2.9 wt. %, preferably to 2.6 wt. %.

Chromium (Cr): the addition of chromium mainly improves the potential hardness increase. Chromium in the dissolved state shifts the perlite and bainite conversion towards longer times and at the same time lowers the martensite starting temperature. A further important effect is that chromium considerably increases the tempering resistance and so in the zinc bath there is almost no loss of strength. Moreover, chromium is a carbide forming agent. Should chromium be present in carbide form, the austenitising temperature must be selected, prior to hardening, to be high enough to dissolve chromium carbides. Otherwise, the increased number of nuclei can cause a deterioration in the potential hardness increase. Chromium likewise tends to form oxides on the steel surface during the annealing treatment, as a result of which the galvanising quality can be impaired. Therefore, the optional Cr content is fixed to values of 0.05 to 0.500 wt. %.

Molybdenum (Mo): the addition of molybdenum is effected, in a similar manner to the addition of chromium, to improve hardenability. The perlite and bainite conversion is shifted towards longer times and the martensite starting temperature is decreased. Moreover, molybdenum considerably increases the tempering resistance so that no losses in strength are to be expected in the zinc bath and effects an increase in strength of the ferrite owing to mixed crystal hardening. The Mo content is added in dependence upon the dimension, the system configuration and the microstructure setting. For cost reasons, the optional Mo content is fixed to 0.05 to 0.5 wt. %.

Copper (Cu): the addition of copper can increase the tensile strength and the potential hardness increase. In conjunction with nickel, chromium and phosphorous, copper can form a protective oxide layer on the surface which can considerably reduce the corrosion rate. In conjunction with oxygen, copper can form, at the grain boundaries, noxious oxides which can produce negative effects particularly for hot-formation processes. Therefore, the optional content of copper is limited to 0.01 to 0.3 wt. %.

Nickel (Ni): in conjunction with oxygen, nickel can form, at the grain boundaries, noxious oxides which can produce negative effects particularly for hot-formation processes. Therefore, the optional content of nickel is limited to 0.01 to 0.050 wt. %.

Microalloy elements are generally added only in very small amounts (<0.1%). In contrast to the alloy elements, they mainly act by precipitate formation but can also influence the properties in the dissolved state. Despite the small amounts added, microalloy elements greatly influence the production conditions and the processing properties and final properties. In general, carbide and nitride forming agents which are soluble in the iron lattice are used as microalloy elements. Formation of carbonitrides is likewise possible by reason of the complete solubility of nitrides and carbides in one another. The tendency to form oxides and sulphides is generally most pronounced with the microalloy elements, but generally is specifically prevented by reason of other alloy elements. This property can be used positively by binding the generally harmful elements sulphur and oxygen. However, the binding can also have negative effects if, as a result, there are no longer sufficient microalloy elements available for the formation of carbides. Typical microalloy elements are aluminium, vanadium, titanium, niobium and boron. These elements can be dissolved in the iron lattice and form carbides and nitrides with carbon and nitrogen.

Titanium (Ti) forms very stable nitrides (TiN) and sulphides (TiS2) even at high temperatures. They only partly dissolve in the melt in dependence upon the nitrogen content. If the thus produced precipitations are not removed with the slag, they form coarse particles in the material owing to the high formation temperature and are generally not conducive to the mechanical properties. A positive effect on the toughness is produced by binding of the free nitrogen and oxygen. Therefore, titanium protects other dissolved microalloy elements such as niobium against being bound by nitrogen. These can then optimally demonstrate their effect. Nitrides which are produced only at lower temperatures by lowering the oxygen and nitrogen content can additionally ensure effective hindrance of the austenite grain growth. Non-bound titanium forms, at temperatures from 1150° C., titanium carbides and can thus effect grain refinement (inhibition of the austenite grain growth, grain refinement by delayed recrystallisation and/or increase in the number of nuclei in $\alpha/\gamma$ conversion) and precipitation hardening. The optional Ti content has values of 0.005 to 0.060 wt. %.

Niobium (Nb) effects considerable grain refinement because it effects a delay in the recrystallisation most effectively among all micro-alloy elements and additionally impedes the austenite grain growth. However, the strength-increasing effect is to be estimated to be qualitatively higher than that of titanium, as can be seen by the increased grain refinement effect and the larger number of strength-increasing particles (binding of the titanium to TiN at high temperatures). Niobium carbides form at temperatures below 1200° C. In the case of nitrogen binding with titanium, niobium can increase its strength-increasing effect by forming small carbides which are effective in terms of their effect in the lower temperature range (smaller carbide sizes). A further effect of the niobium is the delay of the $\alpha/\gamma$ conversion and the reduction of the martensite starting temperature in the dissolved state. On the one hand, this occurs by the solute-drag effect and on the other hand by the grain refinement. This effects an increase in strength of the microstructure and thus also a higher resistance to the increase in volume upon martensite formation. In principle, the addition of niobium by alloying is limited until its solubility limit is reached. Although this limits the amount of precipitations, it primarily effects an early formation of precipitation with quite coarse particles when said limit is exceeded. The precipitation hardening can thus become effective in real terms primarily in steels with a low C content (higher supersaturation possible) and in hot-formation processes (deformation-induced precipitation). Therefore, the Nb content is limited to values of 0.005 to 0.060 wt. %.

Vanadium (V): the carbide and also nitride formation by vanadium first begins at temperatures from about 1000° C. or even after the $\alpha/\gamma$ conversion, i.e. substantially later than for titanium and niobium. Vanadium thus barely has a grain-refining effect owing to the low number of precipitations provided in the austenite. The austenite grain growth is also not hindered by the late precipitation of the vanadium carbides. Therefore, the strength-increasing effect is based virtually exclusively on the precipitation hardening. One advantage of the vanadium is the high solubility in the austenite and the high volume proportion of fine precipitations caused by the low precipitation temperature. Therefore, the optional V content is limited to values of 0.001 to 0.060 wt. %.

Boron (B) forms nitrides and carbides with nitrogen and with carbon respectively; however, this is generally not desired. On the one hand, only a low amount of precipitations are formed owing to the low solubility and on the other hand these are mostly precipitated at the grain boundaries. An increase in hardness at the surface is not achieved (the exception being boronising with formation of FeB and Fe2B in the edge zone of a workpiece). To prevent nitride formation, an attempt is generally made to bind the nitrogen by mean of more affine elements. In particular, titanium can ensure the binding of all of the nitrogen. In the dissolved state, in very small amounts, boron results in a considerable improvement in the potential hardness increase. The mechanism of action of boron can be described in such a way that boron atoms accumulate at the grain boundaries under suitable temperature control and at that location, by lowering the grain boundary energy, significantly hamper the formation of ferrite nuclei capable of growth. When controlling the temperature, care must be taken to ensure that boron is predominantly distributed atomically in the grain boundary and is not present in the form of precipitations by reason of excessively high temperatures. The efficacy of boron is decreased as the grain size increases and the carbon content increases (>0.8%). An amount over 60 ppm additionally causes decreasing hardenability because boron carbides act as nuclei on the grain boundaries. Boron diffuses extraordinarily well by reason of the small atomic diameter and has an extremely high affinity to oxygen which can lead to a reduction in the boron content in regions near to the surface (up to 0.5 mm). In this connection, annealing at over 1000° C. is discouraged. This is also to be recommended because boron can result in an excessive coarse grain formation at annealing temperatures above 1000° C. Boron is an extremely critical element for the process of continuous hot-dip finishing with zinc, as it can form film-like oxides on the steel surface even in the smallest amounts alone or together with manganese during annealing treatment. These oxides passivate the strip surface and prevent the galvanising reaction (iron solution and inhibition layer formation). Whether film-like oxides form depends both upon the amount of free boron and manganese and upon the annealing parameters used (e.g. moisture content in the annealing gas, annealing temperature, annealing time). Higher manganese contents and long annealing times tend to result in globular and less critical oxides. Moreover, by means of an increased moisture content in the annealing gas, it is possible to reduce the amount of boron-containing oxides on the steel surface. For the aforementioned reasons, the B content is limited to values of 0.0001 to 0.0060 wt. %.

Provision is made that by means of the method in accordance with the invention, a value of the $R_{p0.2}$ elasticity limit of the steel strip after the final annealing and final cooling increases by at least 5%, in particular 10%, compared to a value of the $R_{p0.2}$ elasticity limit of the steel strip before the final annealing.

The inventive restoration of the $R_{p0.2}$ elasticity limit of the steel strip by means of the final annealing and the final cooling is effected using one or more of the following conditions:

(1) In-situ deformation of the surrounding microstructure by martensite and/or lower bainite
(2) Optional additional ex-situ deformation by skin pass rolling and/or stretching of the steel strip
(3) Sufficiently high temperatures and time for diffusion of carbon during the final annealing
(4) Sufficient concentration of carbon in supersaturated solution e.g. by suppressing cementite precipitation
(5) Small grain size and optionally dispersed microstructure components/short diffusion paths for carbon Furthermore, in an advantageous manner, provision is made that the value of the $R_{p0.2}$ elasticity limit of the steel strip after the final annealing and final cooling increases by at least 5% to 50% inclusive, in particular to 40% inclusive, compared to the value of the $R_{p0.2}$ elasticity limit of the steel strip before the final annealing. In this case, it is particularly advantageous that a steel strip which has been finally annealed with a Hollomon-Jaffe parameter $Hp=9\times10^3$ and then finally cooled has a value of the $R_{p0.2}$ elasticity limit of the steel strip after the final cooling which has increased by at least 15% compared to a value of the $R_{p0.2}$ elasticity limit of the steel strip before the final annealing.

The Hollomon-Jaffe parameter is defined as $Hp=T_H$ (ln ($\tau$)+20) with $T_H$ in K and $\tau$ in h. It links the maximum temperature $T_H$ and the total duration T of the final annealing (see e.g. A. Kamp, S. Celotto, D. N. Hanlon; Mater. Sci. Eng. A 538 (2012) 35-41). The Hollomon-Jaffe parameter includes the natural logarithm ln(x). In the calculation of Hp in accordance with the present invention, the maximum temperature $T_H$ used is the highest temperature which is reached on the surface of the steel strip during the final annealing. This maximum temperature $T_H$ is decisive for the Hp value in accordance with the invention and the effect of the elasticity limit increase or the occurring metal-physical procedures. Therefore, lower temperatures during the heating phase of the final annealing are neglected. The total duration $\tau$ is defined as the duration of the final annealing. The final cooling is therefore not taken into account in the total duration $\tau$. In the case that the final annealing takes place in a furnace, the total duration starts with a furnace entry and ends with a furnace exit. In a known manner, the final annealing can alternatively take place inductively or conductively.

The Hollomon-Jaffe parameter Hp constitutes, as a process parameter, a further process condition during the final annealing in addition to the temperature and the total duration. Hp thereby restricts the combination possibilities of maximum temperature $T_H$ and total duration $\tau$ such that $12\times10^3>Hp>7.5\times10^3$, preferably $10.5\times10^3>Hp>8\times10^3$ is to be fulfilled.

In accordance with the invention, the steel strip is finally annealed in such a way that the finally annealed and finally cooled steel strip has a value of the tensile strength $R_m$ of the steel strip after the final cooling, which has increased compared to a value of the tensile strength $R_m$ of the steel strip before the final annealing and/or the finally annealed and finally cooled steel strip has a value of the tensile strength $R_m$ of the steel strip after the final cooling which, compared to a value of the tensile strength $R_m$ of the steel strip before the final annealing, is maintained in the sense of not being smaller than before the final annealing.

In an advantageous manner, the finally annealed and finally cooled steel strip has a tensile strength $R_m$ of at least 920 MPa and an elasticity limit $R_{p0.2}$ of at least 720 MPa. Therefore, this steel strip is high-strength. The method is optimised if the steel strip is finally annealed at a maximum temperature $T_H$ and a total duration $\tau$, wherein the following applies: $Hp=T_H$ (ln($\tau$)+20) with $T_H$ in K and $\tau$ in h and $12\times10^3>Hp>7.5\times10^3$, preferably $10.5\times10^3>Hp>8\times10^3$.

In a particular manner, provision is made that the steel strip is finally annealed at a maximum temperature of above 200° C. and/or at a maximum temperature of up to 400° C. and/or at a total duration of 10 s to 500 s. In addition, provision can be made that the steel strip, in particular following the first annealing and first cooling, is subjected to intermediate annealing, in particular continuous annealing, at a temperature between 200° C. to 500° C. inclusive for the total duration of 10 s to 430 s before further cooling. In an advantageous manner, provision is made that the steel strip is cooled to a supercooling temperature below 50° C. and optionally to room temperature.

In one variant, provision is made that the steel strip is intermediately cooled to an intermediate temperature greater than 600° C. after the first annealing and before the first cooling. Preferably, provision is made in this case that the steel strip is intermediately cooled at an average cooling rate of 0.1 K/s to 30 K/s over a time of 5 s to 300 s. Alternatively, it is also possible for the steel strip to be finally annealed in multiple stages (e.g. in a plurality of successive furnaces). If the final annealing is carried out in n-stages, $T_H$, $\tau$ and the Hp value are to be calculated as follows:

The maximum temperature of the final annealing $T_H$ refers to the maximum value of all n stages, i.e. $T_H$=max ($T_{Hi}$), where $T_{Hi}$ is the maximum temperature of the i-th stage.

The total duration $\tau$ of the n-stage annealing is calculated as:

$$\mathcal{T} = \sum_{i=1}^{n} \exp\{(T_{Hi}/T_H)(20 + \ln(T_i)) - 20\},$$

where $\tau_i$ is the annealing duration of the *i*-th stage.

This gives the Hp value for the multi-stage final annealing in known form as:

$$Hp=T_H(\ln(\tau)+20)$$

An advantageous application of the method in accordance with the invention is provided when the steel strip is subjected to intermediate annealing in conjunction with hot-dip coating, in particular hot-dip galvanising, of the steel strip.

It has been found to be preferable to produce the hot-rolled or cold-rolled steel strip from the steel with addition by alloying of Cr and Mo, wherein the following applies: Mn+Cr+4×Mo>2.5 wt. % and 0.1 wt. %≤Mo≤0.5 wt. %.

In an advantageous manner, provision is made in this case that the hot-rolled or cold-rolled steel strip is produced from the aforementioned steel but with a C content of 0.085 to 0.115 wt. % and/or is produced from the aforementioned steel but with an Mn content of 1.6 to 2.6 wt. %.

In an advantageous manner, provision is made that, before the final annealing, the steel strip is subjected to skin pass rolling with a rolling force F [N]>(0.5×β), where β is the width of the steel strip in mm, with a maximum rolling degree of 1.5%.

According to an aspect of the invention, there is also provided a steel strip having a multiphase microstructure, consisting of the following elements in wt. %: C: 0.085 to 0.149; Al: 0.005 to 0.1; Si: 0.2 to 0.75; Mn: 1.6 to 2.9; P: ≤0.02; S: ≤0.005; and optionally one or more of the following elements in wt. %: Cr: 0.05 to 0.5; Mo: 0.05 to 0.5; Ti: 0.005 to 0.060; Nb: 0.005 to 0.060; V: 0.001 to 0.060; B: 0.0001 to 0.0060; N: 0.0001 to 0.016; Ni: 0.01 to 0.5; Cu: 0.01 to 0.3; with the remainder being iron including typical steel-associated elements, characterised in that the steel strip has a product of $R_{p0.2}$ elasticity limit and elongation at fracture A80 of greater than 5600 MPa %, in particular greater than 7200 MPa %. The advantages previously stated in connection with the production method also apply to the steel strip according to the invention. In an advantageous manner, this steel strip is produced according to the production method described above.

In an advantageous manner, Cr and Mo are added to the steel by alloying wherein the following applies: Mn+Cr+4×Mo>2.5 wt. % and 0.1 wt. % s Mo s 0.5 wt. %.

In a particularly preferred manner, the steel strip has a minimum tensile strength of 920 MPa, in particular 980 MPa and/or a bake-hardening value BH2 of ≤25 MPa and/or a residual austenite content of less than 10%, in particular less than 5%.

In an advantageous manner, provision is made that the steel strip has a ratio of the $R_{p0.2}$ elasticity limit of the finally annealed and finally cooled steel strip to the tensile strength $R_m$ of the finally annealed and finally cooled steel strip of greater than 0.68 to 0.97 inclusive.

In an advantageous manner, the microstructure of the finally annealed and finally cooled steel strip has the following composition: ferrite: less than 60%; bainite+martensite: 30% to 98%; residual austenite: less than 10%, in particular less than 5%. The percentages given for the microstructure components refer to area proportions which are typically also adopted as volume proportions.

Preferably, at least 1% fresh martensite is present in the microstructure of the steel strip before the final annealing. The presence of fresh martensite makes the present invention particularly effective, since the fresh martensite ensures a reduction in the elasticity limit, which is then compensated for by the heat treatment in accordance with the invention. The more fresh martensite is present, the more this advantageous effect of the heat treatment increases. Moreover, the microstructure of the finally annealed and finally cooled steel strip is advantageously characterised in that the microstructure has a $KG_5$ characteristic value of less than 0.4, in particular less than 0.3.

In connection with the present invention, room temperature is understood to mean a temperature between 10° C. to 40° C., preferably 15° C. to 25° C.

The method for producing an inventive high-strength steel strip having a multiphase microstructure will be explained in greater detail hereinafter. This production takes place from a cold-rolled or hot-rolled steel strip of different thicknesses via a continuous annealing installation or optionally via a hot-dip galvanising installation. In this case, during first annealing the cold-rolled or hot rolled strip is continuously annealed at a temperature between 750° C. and 950° C. for the total duration of 10 s to 1200 s, in order to set the desired degree of austenitisation. Depending upon the degree of austenitisation, a phase proportion of recovered and/or recrystallised ferrite is retained. The tendency towards recovery and/or recrystallisation can be controlled by the optional elements such as Mo, Ni, Ti and V, wherein higher contents of these elements lead to delayed recrystallisation kinetics. After first cooling to a temperature of 200° C. to 500° C. at an average cooling rate of 2 K/s to 150 K/s, intermediate annealing follows in this temperature range between 200° C. to 500° C. inclusive for a total duration of 10 s to 430 s with the aim of converting the austenite into bainite.

Optionally, hot-dip finishing can be performed. In order to suppress the conversion into ferrite or coarser bainite at higher temperatures during the cooling phase and to achieve a sufficiently large process window, in particular Mn, Mo, Cr, Ni, Nb and B can be added by alloying. During intermediate annealing in the temperature range of 200° C. to 500° C., the conversion of the austenite does not take place completely, as the residual austenite is enriched with carbon and thereby stabilised. Only by cooling down to a supercooling temperature lower than 100° C., preferably lower than 50° C. with an average cooling rate of 1 K/s to 50 K/s, the residual austenite can convert into martensite. By reason of the formation of martensite and the associated shear deformation, glissile dislocations are produced in the surrounding microstructure, which from a technological point of view manifests itself in a lowering of the $R_{p0.2}$ elasticity limit. In order to restore the elasticity limit and a high elasticity limit ratio >0.68 to 0.97 inclusive of the steel in accordance with the invention, a heat treatment after cooling below 100° C., preferably below 50° C., is necessary. During the final annealing, the tetragonality of the martensitic tetragonal space-centred phase is degraded, in that carbon diffuses into surrounding microstructure regions and glissile (slidable) dislocations due to Cotrell clouds form sessile (immovable) dislocations. Of technological relevance is the restoration of the high elasticity limit which takes place in the process, as well as a reduction in edge crack sensitivity through conversion of martensite with a hard tetragonal space-centred structure to the cubic space-centred structure. In order to increase the tempering resistance and prevent a loss of tensile strength, Mo or V can optionally be added by alloying. Depending upon temperature and time of the final annealing, a variable elasticity limit ratio can be set. In order to achieve a significant increase in the elasticity limit, final annealing with a maximum temperature $T_H$ of at least 100° C. has been shown to be effective in large-scale production. The final microstructure of the multiphase steel according to the invention is composed of <60% ferrite, 30 to 98% bainite and martensite (fresh or tempered before the final annealing and tempered after the final annealing), wherein at least 1% fresh martensite is present before the final annealing, as well as a low content of residual austenite of less than 10%, preferably less than 5%.

Basically, the individual annealing treatments can be multi-stage or additional annealing treatments can also be provided in relation to the entire process.

Tables 2a and 2b list the relevant process parameters of continuous annealing for an exemplary selection of temperature cycles Ia to VII of continuous annealing, said process parameters being used for producing the steel strip in accordance with the invention. The following process parameters are listed in tables 2a and 2b:

$T_{IA}$: maximum annealing temperature in the intercritical range (first annealing)

$t_{IA}$: duration of annealing (first annealing)

$T_m$: intermediate temperature $CR_1$: average cooling rate during cooling from $T_{IA}$ to $T_m$ $T_{OA}$: cooling stop temperature $CR_2$: average cooling rate during cooling from $T_m$ to $T_{OA}$ $t_{OA}$: holding time to $T_{OA}$ $T_{HD}$: temperature of hot-dip finishing (intermediate annealing)

$T_0$: supercooling temperature after hot-dip finishing $CR_3$: average cooling rate after hot-dip finishing $T_H$: maximum final annealing temperature after cooling to $T_0$ $\tau$: final annealing duration Hp: Hollomon-Jaffe parameter $Hp=T_H(\ln(\tau)+20)$ with $T_H$ in K and $\tau$ in h The final annealing is described as the last step of the continuous annealing by the Hollomon-Jaffe parameter Hp described above. Laboratory tests and large-scale tests were conducted with the temperature cycles given in Tables 2a and 2b and the steel strip produced was then characterised with regard to mechanical-technological characteristic values. Laboratory tests relate in each case to the last step of the final annealing after $T_0$ has been reached and were simulated on previously large-scale produced steel strip in a continuous annealing process on a laboratory scale in order to determine the dependence of the final properties upon the Hp value.

In a subsequent Table 3—split into Table 3a and 3b—mechanical characteristic values in the longitudinal direction (rolling direction) of the reference steels $A_I$ and $B_{II}$ and inventive example steels $C_{III}$, $D_{IV}$, $D_V$, $E_{VI}$, $F_{VII}$ and $G_{VIII}$ before and after the final annealing as well as the relative change of the $R_{p0.2}$ elasticity limit by reason of the final annealing at a corresponding Hp value are given. The following mechanical characteristic values are listed in Tables 3a and 3b:

$R_{p0.2}^0$: elasticity limit before the final annealing $R_m^0$: tensile strength before the final annealing $A_{80}^0$: elongation at fracture before the final annealing $R_{p0.2}^f$: elasticity limit after complete temperature cycle $R_m^f$: tensile strength after complete temperature cycle $R_{p0.2}^f/Rm^f$: elasticity limit ratio after complete temperature cycle $A_{80}^f$: elongation at fracture after complete temperature cycle $\Delta R_{p0.2}$: change in elasticity limit by final annealing $\Delta R^m$: change in tensile strength by final annealing $\Delta R_{p0.2}/R_{p0.2}^0$: Relative increase in elasticity limit by final annealing In this case, the reference steels and the example steels in accordance with the invention have a comparable $R_{p0.2}$ elasticity limit ($R_{p0.2}^0$) before the final annealing. Depending upon the temperature cycle, in the case of the example steel in accordance with the invention an elasticity limit ratio R $R_{p0.2}^f/R_m^f$ of 0.93 can be achieved (see e.g. temperature cycle IIIa). The example steel in accordance with the invention retains a high elongation at fracture of >9%. High Hp values are required to achieve a high elasticity limit (see FIG. 1). Too low Hp values do not lead to a significant increase in the elasticity limit; e.g. during temperature cycle IIIf with an increase of only 1% at Hp=6.5 (Table 2). The tensile strength of the steels in accordance with the invention likewise increases by reason of the final annealing, so that a final tensile strength $R_m^f$ of >920 MPa is achieved, which is significantly higher than the tensile strength $R_m^f$ of the reference steels $A_I$ and $B_{II}$. In this case, the example steels $C_{IIIC}$, $D_{IV}$ and $D_V$ treated according to the temperature cycles IIIf, IVe, Vg, Vh have been evaluated as not inventive, since the Hp value is less than or equal to 7.5 and the increase in the elasticity limit is less than 5%.

FIG. 1 illustrates a diagram of a relative increase in the $R_{p0.2}$ elasticity limit of the steel sheet, as achieved by the final annealing in accordance with the invention, as a function of the Hollomon-Jaffe parameter Hp. For this purpose, an x/y diagram plots a ratio $\Delta R_{p0.2}/R_{p0.2}^0$ of the change in the $R_{p0.2}$ elasticity limit ($\Delta R_{p0.2}$) of the steel strip by means of the final annealing to the $R_{p0.2}$ elasticity limit of the steel strip before the final annealing ($R_{p0.20}$) with values of 0 to 0.5 on the y-axis and the Hollomon-Jaffe parameters $Hp=T_H(\ln(\tau)+20)$ [$10^3$] with $T_H$ in K (maximum final annealing temperature after cooling to the supercooling temperature $T_0$) and $\tau$ in h with values of 6 to 11 [$10^3$] on the x-axis. By means of the Hollomon-Jaffe parameter Hp, the conditions of the final annealing can be characterised via the final annealing duration $\tau$ and the maximum final annealing temperature $T_H$. In the diagram, five curves are drawn for the reference steel $A_I$, with the temperature cycle group Ia-f, for the reference steel $B_{II}$ with the temperature cycle group IIa-e, for the inventive example steel $C_{III}$ with the temperature cycle group IIIa-f and the inventive example steels $D_{IV}$ and $D_V$ with the temperature cycle groups IVa-e and Va-h. The curves were fitted on the basis of measurement data from the tests (see Table 3) by means of an adapted Johnson-Mehl-Avrami-Kolmogorov equation (see e.g. A. Kolmogoroff; Izv. Akad. Nauk SSSR Ser. Mat. 1 (1937) 355-359) which describes both the kinetics of the conversion of the martensitic tetragonal space-centred phase into a cubic space-centred phase and the associated simultaneous increase in the elasticity limit during the annealing treatment. The reference steel $A_I$, processed over the temperature cycle I, shows the smallest increase in the elasticity limit with ca. 20% at $Hp=11\times10^3$. Reference steel $B_{II}$, processed over temperature cycle II, shows a higher relative increase in the elasticity limit compared to reference steel A, but only at higher Hp values from $9\times10^3$. Higher Hp values are to be classified as more difficult in terms of technical implementation, as higher final annealing temperatures and/or final annealing times are required. Higher final annealing temperatures can lead to undesirable changes in a coating, whereas higher final annealing times result in reduced productivity in large-scale production. Therefore, lower Hp values are to be aimed for.

A significantly higher increase in the elasticity limit compared to the reference steels $A_I$ and $B_{II}$ can be seen in the example steels $C_{III}$, $D_{IV}$ and $D_V$ in accordance with the invention. In the case of an Hp value of $9\times10^3$, the increase in the $R_{p0.2}$ elasticity limit for steel $C_{III}$, processed over temperature cycle IIIa-f, for steel $D_{IV}$, processed over temperature cycle IVa-e, and for steel $D_V$, processed over temperature cycle Va-h is already over 20%, while the reference steels $A_I$ and $B_{II}$ are <10%. Therefore, the example steels in accordance with the invention show a significant increase in the elasticity limit even in the case of lower Hp values, which is due to their composition, in particular the increased Si content, whereby cementite precipitations are avoided and the carbon necessary for increasing the elasticity limit remains dissolved. Although the C content of the reference steels A and B is significantly higher, the increase in the elasticity limit is substantially lower compared to the steels in accordance with the invention.

Table 4 lists the microstructure components for the steels $A_I$-$G_{VIII}$.

The microstructure components were determined in the longitudinal polished section perpendicular to the rolling surface by means of measurements using electron backscatter diffraction with the aid of the Kikuchi band contrast as well as light-optical images. In addition, the grain diameters were determined from the measurements by means of electron backscatter diffraction, wherein a grain is defined by the fact that it has a grain boundary with a disorientation angle of ≥15° (so-called large angle grain boundary—GWKG, see G. Gottstein, Physikalische Grundlagen der Materialkunde, Springer-Verlag Berlin Heidelberg, 2007).

The microstructure of the steels $C_{III}$-$G_{VIII}$ in accordance with the invention is composed of <60% ferrite, 30 to 98% bainite and martensite (fresh or tempered martensite before the final annealing and tempered martensite after the final annealing), wherein at least 1% fresh martensite is present before the final annealing, as well as a content of residual austenite <10%, in particular <5%. Moreover, the microstructure of the steels $C_{III}$ to $G_{VIII}$ in accordance with the invention has a $KG_5$ characteristic value <0.4, preferably <0.3.

Fresh martensite has a high dislocation density and high hardness by reason of its formation mechanism. In the case of electron backscatter diffraction, such regions appear darker than other microstructure components in the Kikuchi band contrast because the diffraction condition is violated by a disturbed crystal lattice. From this, the proportion of fresh martensite can be quantitatively determined. Alternatively, the formation of fresh martensite can be established with the aid of the dilatometry on the basis of the change in volume when a sample is cooled.

The $KG_5$ characteristic value does not change during the final annealing. The percentages given for the microstructure components refer to area proportion which are typically also adopted as volume proportions In the present case, martensite is defined as tempered if the fresh martensite, after formation thereof, has been subsequently annealed once again at least at a minimum temperature of 100° C. The minimum temperature of 100° C. corresponds to the minimum temperature of the final annealing in accordance with the invention. In the present case, the fresh martensite before the final annealing is then understood to be tempered martensite after the final annealing. Therefore, fresh martensite is a conversion product of the austenite which is formed during cooling and is not tempered.

For the reference steel $A_I$, the microstructure does not change in the material-technical sense for the different temperature cycles of the final annealing examined (temperature cycle up to the final annealing is identical), therefore the microstructure given in Table 4 for steel $A_I$ applies to all temperature cycles Ia-f. The same applies to the microstructure components of the steels $B_{II}$ und $D_{IV}$ in Table 4.

As previously described, a temperature cycle in accordance with the invention requires an Hp value of >7.5. A $KG_5$ value of <0.3 does not necessarily mean that any temperature cycle is successful, but represents an advantageous criterion for the final annealing to be successful from Hp>7.5.

The $KG_5$ characteristic value designates the area proportion of grains with an equivalent diameter $d=\sqrt{(4A/\pi)}>5$ μm, where A is the area of a grain, and a shape factor F<3.

The shape factor is calculated as $F=P/\sqrt{4\pi A}$, where P is the circumference and A is the area of a grain. Round grains have a shape factor close to 1 (globular), while elongated grains or grains with irregular grain boundaries have a higher shape factor >1.

The $KG_5$ value does not change during the final annealing.

By restricting the shape factor to F<3, greatly elongated irregular microstructure components from the rolling process are of no consequence when considering grain sizes. The $KG_5$ characteristic value thus correlates with coarse microstructure components which are newly formed during cooling after first annealing.

The microstructure components which are newly formed after the first annealing are decisive for the elasticity limit, as the elasticity limit is reduced by reason of the formation of fresh martensite in these regions. For successful subsequent final annealing and a strong increase/restoration of the elasticity limit, short diffusion paths are necessary, which preferably requires the smallest possible grain size and thus a low $KG_5$ characteristic value <0.4, advantageously <0.3.

Figure 2:
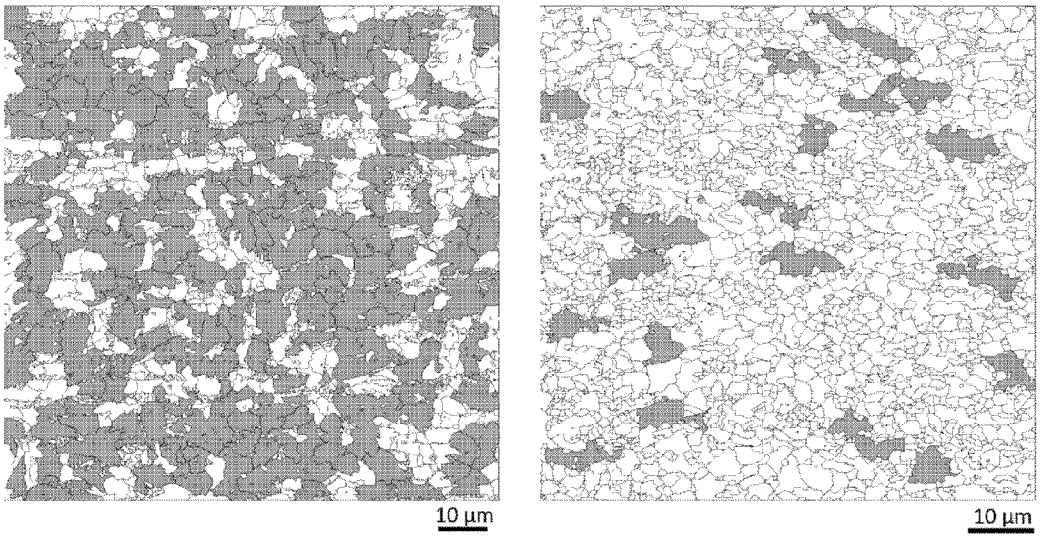
FIG. 2 illustrates an exemplary comparison of the microstructure of a reference steel $B_{II}$ (left microstructure image) with a $KG_5$ characteristic value of 0.58 and the example steel $D_{IV}$ (right microstructure image) with a $KG_5$ characteristic value of 0.1.

An exemplary comparison of the microstructure of the reference steel $B_{II}$ (left microstructure image) with a $KG_5$ characteristic value of 0.58 and the example steel $D_{IV}$ (right microstructure image) with a $KG_5$ characteristic value of 0.1 is shown in FIG. 2.

Grains having an equivalent diameter d>5 μm and shape factor F<3 are marked in grey in FIG. 2, the remaining fine microstructure is shown in white. It is advantageous for the invention to have as low a proportion of grains shown in grey as possible, which is reflected by the $KG_5$ characteristic value.

TABLE 1

| | Chemical composition (in each case in wt. %) | | | | | | | | | | | |
|---|---|---|---|---|---|---|---|---|---|---|---|---|
| No. | C | Si | Mn | P | N | Al | Cr | Mo | Ti | V | Nb | B |
| $A_I$ | 0.157 | 0.248 | 1.833 | 0.013 | 0.0068 | 0.045 | 0.390 | 0.005 | 0.002 | 0.005 | 0.015 | <0.005 |
| $B_{II}$ | 0.150 | 0.276 | 1.843 | 0.010 | 0.0060 | 0.044 | 0.334 | 0.001 | 0.004 | 0.003 | 0.015 | <0.005 |
| $C_{III}$ | 0.105 | 0.488 | 2.154 | 0.011 | 0.0048 | 0.045 | 0.328 | 0.213 | 0.036 | 0.006 | 0.033 | 0.0005 |
| $D_{IV}$, $D_v$ | 0.103 | 0.473 | 2.163 | 0.014 | 0.0053 | 0.035 | 0.327 | 0.216 | 0.026 | 0.004 | 0.037 | 0.0003 |
| $E_V$ | 0.099 | 0.453 | 2.131 | 0.008 | 0.0066 | 0.037 | 0.307 | 0.211 | 0.025 | 0.006 | 0.034 | 0.0005 |
| $F_{VI}$ | 0.097 | 0.461 | 2.174 | 0.011 | 0.0071 | 0.046 | 0.322 | 0.217 | 0.029 | 0.005 | 0.034 | 0.0005 |
| $G_{VII}$ | 0.098 | 0.489 | 2.194 | 0.013 | 0.0067 | 0.038 | 0.307 | 0.214 | 0.031 | 0.005 | 0.035 | 0.0004 |

TABLE 2a

| Temp. cycle | $T_{IA}$ (° C.) | $t_{IA}$ (s) | $T_m$ (° C.) | $CR_1$ (K/s) | $T_{OA}$ (° C.) | $CR_2$ (K/s) | $t_{OA}$ (s) | $T_{HD}$ (° C.) | $T_0$ (° C.) | $CR_3$ (K/s) | $T_H$ (° C.) | τ (s) | Hp ($1 \times 10^3$) | Observation |
|---|---|---|---|---|---|---|---|---|---|---|---|---|---|---|
| Ia | 840 | 270 | 760 | 2 | 410 | 16 | 81 | 460 | 20 | 5 | 290 | 168 | 9.5 | Laboratory test |
| Ib | | | | | | | | | | | 260 | 168 | 9.0 | Laboratory test |
| Ic | | | | | | | | | | | 230 | 168 | 8.5 | Laboratory test |
| Id | | | | | | | | | | | 200 | 168 | 8.0 | Laboratory test |
| Ie | | | | | | | | | | | 200 | 84 | 7.7 | Laboratory test |
| If | | | | | | | | | | | 145 | 42 | 6.5 | Laboratory test |
| IIa | 840 | 270 | 670 | 3 | 370 | 14 | 81 | 460 | 20 | 5 | 280 | 168 | 9.4 | Laboratory test |
| IIb | | | | | | | | | | | 245 | 168 | 8.8 | Laboratory test |
| IIc | | | | | | | | | | | 190 | 168 | 7.8 | Laboratory test |
| IId | | | | | | | | | | | 190 | 84 | 7.5 | Laboratory test |
| IIe | | | | | | | | | | | 130 | 42 | 6.3 | Laboratory test |
| IIIa | 825 | 324 | 770 | 1 | 320 | 18 | 98 | 460 | 20 | 4 | 290 | 168 | 9.5 | Laboratory test |
| IIIb | | | | | | | | | | | 290 | 84 | 9.1 | Laboratory test |
| IIIc | | | | | | | | | | | 250 | 168 | 8.9 | Large-scale test |
| IIId | | | | | | | | | | | 250 | 42 | 8.1 | Laboratory test |
| IIIe | | | | | | | | | | | 200 | 84 | 7.7 | Laboratory test |
| IIIf | | | | | | | | | | | 145 | 42 | 6.5 | Laboratory test |
| IIIg | 860 | 324 | 785 | 1 | 320 | 18 | 98 | 460 | 20 | 4 | 250 | 168 | 8.9 | Large-scale test |
| IIIh | 840 | 324 | 780 | 1 | 320 | 18 | 98 | 460 | 20 | 4 | 250 | 168 | 8.9 | Large-scale test |
| IIIi | 815 | 324 | 770 | 1 | 320 | 18 | 98 | 460 | 20 | 4 | 250 | 168 | 8.9 | Large-scale test |

TABLE 2b

| Temp. cycle | $T_{IA}$ (° C.) | $t_{IA}$ (s) | $T_m$ (° C.) | $CR_1$ (K/s) | $T_{OA}$ (° C.) | $CR_2$ (K/s) | $t_{OA}$ (s) | $T_{HD}$ (° C.) | $T_0$ (° C.) | $CR_3$ (K/s) | $T_H$ (° C.) | τ (s) | Hp ($1 \times 10^3$) | Observation |
|---|---|---|---|---|---|---|---|---|---|---|---|---|---|---|
| IVa | 825 | 257 | 770 | 1 | 320 | 22 | 78 | 460 | 20 | 5 | 290 | 168 | 9.5 | Laboratory test |
| IVb | | | | | | | | | | | 270 | 168 | 9.2 | Large-scale test |
| IVc | | | | | | | | | | | 250 | 168 | 8.9 | Laboratory test |
| IVd | | | | | | | | | | | 200 | 84 | 7.7 | Laboratory test |
| IVe | | | | | | | | | | | 140 | 42 | 6.4 | Laboratory test |
| Va | 815 | 190 | 770 | 2 | 320 | 30 | 57 | 460 | 20 | 7 | 330 | 84 | 9.8 | Laboratory test |
| Vb | | | | | | | | | | | 270 | 168 | 9.2 | Laboratory test |
| Vc | | | | | | | | | | | 250 | 136 | 8.7 | Laboratory test |
| Vd | | | | | | | | | | | 240 | 112 | 8.5 | Laboratory test |
| Ve | | | | | | | | | | | 210 | 168 | 8.2 | Laboratory test |
| Vf | | | | | | | | | | | 210 | 84 | 7.8 | Laboratory test |
| Vg | | | | | | | | | | | 190 | 84 | 7.5 | Laboratory test |
| Vh | | | | | | | | | | | 170 | 42 | 6.9 | Laboratory test |

TABLE 2b-continued

| Temp. cycle | $T_{IA}$ (° C.) | $t_{IA}$ (s) | $T_m$ (° C.) | $CR_1$ (K/s) | $T_{OA}$ (° C.) | $CR_2$ (K/s) | $t_{OA}$ (s) | $T_{HD}$ (° C.) | $T_0$ (° C.) | $CR_3$ (K/s) | $T_H$ (° C.) | τ (s) | Hp ($1 \times 10^3$) | Observation |
|---|---|---|---|---|---|---|---|---|---|---|---|---|---|---|
| VI | 840 | 270 | 670 | 4 | 370 | 14 | 81 | 460 | 20 | 5 | 240 | 112 | 8.5 | Large-scale test |
| VII | 820 | 202 | 710 | 3 | 330 | 24 | 61 | 460 | 20 | 6 | 230 | 120 | 8.4 | Large-scale test |
| VIII | 825 | 324 | 770 | 1 | 320 | 18 | 98 | 460 | 20 | 4 | 250 | 168 | 8.9 | Large-scale test |

TABLE 3a

| No. | Temp. cycle | Thickness [mm] | $R_{p0.2}^0$ [MPa] | $R_m^0$ [MPa] | $A_{80}^0$ [%] | $R_{p0.2}^f$ [MPa] | $R_m^f$ [MPa] | $R_{p0.2}^f/R_m^f$ | $A_{80}^f$ [%] | $\Delta Rp_{0.2}$ [MPa] | $\Delta R_m$ [MPa] | $\Delta R_{p0.2}/R_{p0.2}^0$ [%] | Invention |
|---|---|---|---|---|---|---|---|---|---|---|---|---|---|
| $A_I$ | Ia | 1.5 | 640 | 824 | 15.7 | 718 | 828 | 0.87 | 14.9 | 78 | 4 | 12 | No |
| | Ib | | | | | 700 | 828 | 0.85 | 14.9 | 60 | 4 | 9 | No |
| | Ic | | | | | 683 | 830 | 0.82 | 15.7 | 43 | 6 | 7 | No |
| | Id | | | | | 660 | 830 | 0.80 | 15.7 | 20 | 6 | 3 | No |
| | Ie | | | | | 654 | 829 | 0.79 | 15.8 | 14 | 5 | 2 | No |
| | If | | | | | 646 | 829 | 0.78 | 15.9 | 6 | 5 | 1 | No |
| $B_{II}$ | IIa | 1.7 | 569 | 828 | 16.7 | 655 | 829 | 0.79 | 16.4 | 86 | 1 | 15 | No |
| | IIb | | | | | 606 | 832 | 0.73 | 13.9 | 37 | 4 | 7 | No |
| | IIc | | | | | 585 | 826 | 0.71 | 14.7 | 16 | −2 | 3 | No |
| | IId | | | | | 575 | 823 | 0.70 | 16.6 | 6 | −5 | 1 | No |
| | IIe | | | | | 574 | 827 | 0.69 | 14.8 | 5 | −1 | 1 | No |
| $C_{III}$ | IIIa | 1.5 | 720 | 1010 | 12.9 | 966 | 1040 | 0.93 | 10.1 | 246 | 30 | 34 | Yes |
| | IIIb | | | | | 961 | 1045 | 0.92 | 11.6 | 241 | 35 | 33 | Yes |
| | IIIc | | | | | 871 | 1031 | 0.84 | 12.6 | 151 | 21 | 21 | Yes |
| | IIId | | | | | 768 | 1018 | 0.75 | 11.8 | 48 | 8 | 7 | Yes |
| | IIIe | | | | | 763 | 1016 | 0.75 | 12.1 | 43 | 6 | 6 | Yes |
| | IIIf | | | | | 730 | 1016 | 0.72 | 11.6 | 10 | 6 | 1 | No |
| | IIIg | | 707 | 949 | 13.8 | 806 | 963 | 0.84 | 12.6 | 99 | 14 | 14 | Yes |
| | IIIh | | 706 | 990 | 13.6 | 850 | 1011 | 0.84 | 12.0 | 144 | 21 | 20 | Yes |
| | IIIi | | 785 | 1088 | 11.1 | 921 | 1091 | 0.84 | 9.2 | 136 | 3 | 17 | Yes |

TABLE 3b

| No. | Temp. cycle | Thickness [mm] | $R_{p0.2}^0$ [MPa] | $R_m^0$ [MPa] | $A_{80}^0$ [%] | $R_{p0.2}^f$ [MPa] | $R_m^f$ [MPa] | $R_{p0.2}^f/R_m^f$ | $A_{80}^f$ [%] | $\Delta R_{p0.2}$ [MPa] | $\Delta R_m$ [MPa] | $\Delta R_{p0.2}/R_{p0.2}^0$ [%] | Invention |
|---|---|---|---|---|---|---|---|---|---|---|---|---|---|
| $D_{IV}$ | IVa | 1.2 | 693 | 994 | 12.5 | 910 | 1010 | 0.90 | 11.3 | 217 | 16 | 31 | Yes |
| | IVb | | | | | 856 | 1011 | 0.85 | 11.0 | 163 | 17 | 24 | Yes |
| | IVc | | | | | 822 | 1006 | 0.82 | 11.4 | 129 | 12 | 19 | Yes |
| | IVd | | | | | 735 | 995 | 0.74 | 11.7 | 42 | 1 | 6 | Yes |
| | IVe | | | | | 709 | 997 | 0.71 | 13.5 | 16 | 3 | 2 | No |
| $D_V$ | Va | 1.0 | 689 | 1006 | 13.3 | 932 | 1022 | 0.91 | 10.9 | 243 | 16 | 35 | Yes |
| | Vb | | | | | 879 | 1023 | 0.86 | 11.9 | 190 | 17 | 28 | Yes |
| | Vc | | | | | 821 | 1020 | 0.80 | 11.3 | 132 | 14 | 19 | Yes |
| | Vd | | | | | 780 | 1015 | 0.77 | 12.6 | 91 | 9 | 13 | Yes |
| | Ve | | | | | 759 | 1008 | 0.75 | 13.7 | 70 | 2 | 10 | Yes |
| | Vf | | | | | 747 | 1008 | 0.74 | 13.8 | 58 | 2 | 8 | Yes |
| | Vg | | | | | 714 | 1008 | 0.71 | 13.4 | 25 | 2 | 4 | No |
| | Vh | | | | | 691 | 1007 | 0.69 | 13.8 | 2 | 1 | 0 | No |
| $E_{VI}$ | VI | 1.0 | 649 | 944 | 11.5 | 819 | 968 | 0.85 | 11.1 | 170 | 24 | 26 | Yes |
| $F_{VII}$ | VII | 1.2 | 616 | 915 | 14.3 | 745 | 932 | 0.80 | 12.5 | 129 | 17 | 21 | Yes |
| $G_{VIII}$ | VIII | 1.5 | 720 | 998 | 13.8 | 878 | 1010 | 0.87 | 12.5 | 158 | 12 | 22 | Yes |

TABLE 4

| No. | Temp. cycle | Ferrite [%] | Bainite + martensite [%] | of which fresh martensite before final annealing [%] | Residual austenite [%] | Proportion of grains (15° GWKG) with grain diameter > 5 μm and shape factor F < 3 $KG_5$ |
|---|---|---|---|---|---|---|
| $A_I$ | Ia-f | 3 | 96 | 1 | 1 | 0.49 |
| $B_{II}$ | IIa-e | 89 | 10 | 10 | 1 | 0.58 |
| $C_{III}$ | IIIg | 8 | 90 | 7 | 2 | 0.14 |
| $C_{III}$ | IIIh | 10 | 89 | 2 | 1 | 0.06 |
| $C_{III}$ | IIIi | 28 | 72 | 7 | <1 | 0.16 |
| $D_{IV}$ | IVa-e | 32 | 68 | 10 | <1 | 0.1 |
| $E_{VI}$ | VI | 32 | 68 | 5 | <1 | 0.2 |
| $F_{VII}$ | VII | 37 | 63 | 7 | <1 | 0.17 |
| $G_{VIII}$ | VIII | 36 | 63 | 8 | 1 | 0.18 |

The invention claimed is:

1. A steel strip having a multiphase microstructure consisting of the following elements in wt. %:

C: 0.085 to 0.149

Al: 0.005 to 0.1

Si: 0.2 to 0.75

Mn: 1.6 to 2.9

P: ≤0.02

S: ≤0.005 and optionally one or more of the following elements in wt. %:

Cr: 0.05 to 0.5;

Mo: 0.05 to 0.5;

Ti: 0.005 to 0.060;

Nb: 0.005 to 0.060;

V: 0.001 to 0.060;

B: 0.0001 to 0.0060;

N: 0.0001 to 0.016;

Ni: 0.01 to 0.5; and

Cu: 0.01 to 0.3 with the remainder being iron and incidental steel-associated impurities;

wherein the steel strip has a product of $R_{p0.2}$ elasticity limit and elongation at fracture $A_{80}$ of greater than 5600 MPa %, a tensile strength $R_m$ of at least 920 MPa and an elasticity limit $R_{p0.2}$ of at least 720 MPa and the steel strip has the following microstructure components in which the percentages given refer to area proportions:

ferrite: less than 60%, bainite+martensite: 30% to 98%, residual austenite: less than 10%;

and wherein grains which are limited by large angle grain boundaries can be identified in the microstructure of the steel strip in a finally annealed and finally cooled condition and the microstructure has a $KG_5$ characteristic value of less than 0.4, wherein the $KG_5$ characteristic value designates the area proportion of grains with an equivalent diameter d, where $d=\sqrt{(4A/\pi)}>5$ μm and a shape factor F, where $F=P/\sqrt{4\pi A}<3$ and where P is a circumference and A is an area of a respective grain and a determination thereof is effected by means of electron backscatter diffraction.

2. The steel strip as claimed in claim 1, wherein the optional Cr and Mo are added to the steel by alloying, and wherein the following applies: Mn+Cr+4×Mo>2.5 wt. % and 0.1 wt. %≤Mo≤0.5 wt. %.

3. The steel strip as claimed in claim 1, wherein the steel strip has a minimum tensile strength of 980 MPa.

4. The steel strip as claimed in claim 1, wherein the steel strip has a bake-hardening value BH2 of ≥25 MPa.

5. The steel strip as claimed in claim 1, wherein the steel strip has a ratio of the $R_{p0.2}$ elasticity limit of the finally annealed and finally cooled steel strip to the tensile strength $R_m$ of the finally annealed and finally cooled steel strip of greater than 0.68 to 0.97 inclusive.

6. The steel strip as claimed in claim 1, wherein the microstructure of the steel strip has less than 5% residual austenite in which the percentage refers to area proportion.

* * * * *